United States Patent [19]

Lal et al.

[11] 4,238,551

[45] Dec. 9, 1980

[54] COMPOSITION FOR INHIBITING CORROSION OF TITANIUM

[75] Inventors: Sudarshan Lal, Glen Rock, N.J.; Richard V. Porcelli, Yonkers, N.Y.

[73] Assignee: Halcon Research & Development Corporation, New York, N.Y.

[21] Appl. No.: 17,756

[22] Filed: Mar. 5, 1979

[51] Int. Cl.[3] ..... B32B 15/00

[52] U.S. Cl. ..... 428/660; 428/670; 428/935

[58] Field of Search ..... 428/660, 670, 935

[56] References Cited

U.S. PATENT DOCUMENTS

| | | | |
|---|---|---|---|
| 1,949,131 | 2/1934 | Shields | 204/1 |
| 1,981,820 | 11/1934 | Zimmerman et al. | 204/1 |
| 3,278,404 | 11/1966 | Cotton et al. | 426/660 X |
| 3,457,103 | 7/1969 | Keller et al. | 428/433 |
| 3,474,520 | 10/1969 | Takizawa et al. | 426/660 X |
| 4,137,370 | 1/1979 | Fujishiro et al. | 428/660 |

FOREIGN PATENT DOCUMENTS

| | | | |
|---|---|---|---|
| 48-25636 | 4/1973 | Japan . | |
| 1051994 | 12/1966 | United Kingdom | 426/660 |

OTHER PUBLICATIONS

Covington, *Titanium Science and Technology,* vol. 4, 1973, pp. 2395–2403.

*Chemical Engineering Progress,* vol. 66, No. 10, Oct. 1970, pp. 53–56, 57–62.

Klinov, *Corrosion and Protection of Materials used in Industrial Equipment,* 1962, pp. 79–91.

Stern et al., *J. of the Electrochem. Soc.,* vol. 106, No. 9, Sep. 1959, pp. 759–764.

Fukutsuka et al., "Corrosion Resistance of Titanium Tubes in the MSF Desalination Plants," Japan.

Kostic et al., Br. Corros. J., vol. 9, No. 4, 1974, pp. 211–215.

Chem. Abst., vol. 77, 108851g, 134,374y (1972).

Chem. Abst., vol. 76, 89375r, 93908j, 93909k (1972).

Chem. Abst., vol. 78, 78899e, 105435j (1973).

Chem. Abst., vol. 80, 152139s, 66206e, 103267y (1974).

Chem. Abst., vol. 84, 81494y (1976).

Chem. Abst., vol. 88, 93630k (1978).

Chem. Abst., vol. 89, 82148d, 93802p (1978).

*Modern Electroplating,* John Wiley, New York, 1963, pp. 310–325.

*J. of Electrochem. Soc.,* vol. 106, No. 9, Sep. 1959, pp. 755–759.

*Trans. Electrochem. Soc.,* vol. 63, 1933, pp. 181–185.

*Trans. Inst. Metal Finishings,* vol. 29, 1953, pp. 1–23.

*A.S.M., "Surface Protection Against Wear and Corrosion,"* 1954, pp. 52–55.

*Plating,* vol. 42, 1955, pp. 882–892.

*Trans. Inst. Metal Finishing,* vol. 36, 1959, pp. 74–81.

*Platinum Metals Rev.,* vol. 5(1), 1961, pp. 13–18.

*Corrosion,* vol. 1, pp. 6.3–6.28 and vol. 2, pp. 14.100–14.104, 1963.

*Trans. Inst. Met. Finishing,* vol. 33, 1956, pp. 424–439.

*Titanium Science and Technology,* vol. 4, 1973, pp. 2383–2393.

*Corrosion and Corrosion Control,* Uhlig, 1963, pp. 319–323.

*Corrosion,* vol. 19, No. 6 (1963), pp. 217t–221t.

Chem. Abst., vol. 79, 10422j (1973).

*Primary Examiner*—G. Ozaki

*Attorney, Agent, or Firm*—William C. Long; David Dick; Jack B. Murray, Jr.

[57] ABSTRACT

A process is provided for inhibiting the rate of corrosion of titanium metal surfaces from attack by strong acid media in which at least a portion of the titanium metal surface is coated with rhodium metal to provide a treated metal surface which is substantially impervious to corrosion by strong acid media. The article so prepared appears to be uniquely impervious to corrosion by strong acid media and is also claimed herein.

4 Claims, No Drawings

COMPOSITION FOR INHIBITING CORROSION OF TITANIUM

BACKGROUND OF THE INVENTION

1. Field of the Invention

This invention is generally related to the minimization of corrosion of titanium and titanium alloy metal surfaces and, more specifically, to the provision on at least a portion of the metal surface of rhodium metal.

2. Description of the Prior Art

Titanium and titanium alloys are, largely due to their generally high corrosion-resistance properties, widely used in industry as construction material or linings for vessels, piping and the like.

However, unacceptably high rates of corrosion of titanium can occur at elevated temperatures when in contact with strong acid media, e.g., aqueous media containing any of the strong mineral acids, such as nitric acid, phosphoric acid, sulfuric acid, hydrohalic acids (e.g., HBr, HCl, HI and HF), and the like, or any of the strong carboxylic acids, such as oxalic acid, formic acid, acetic acid and the like. Also, aqueous media containing dissolved salts of some of the above acids can vigorously attack titanium and titanium alloys.

Various compounds have been proposed for use as anticorrosive agents for titanium. Thus, U.S. Pat. No. 3,457,103 suggests use of siliceous compounds in the offending corrosive media. Also $Fe^{3+}$, $Cu^{2+}$ and $Pt^{4+}$, as well as ions of Au, Hg, Zn, Co, Al and Mg, have been found to decrease rates of corrosion or to passivate titanium in certain media. See I. Ya. Klinov, *Corrosion and Protection of Materials Used in Industrial Equipment* pp. 79–90 (Consultants Bureau 1962); *Corrosion* vol. 19, No. 6, pp. 217t–221t (1963); N. G. Feige et al., *Chem. Eng. Prog.*, vol. 66, No. 10, pp. 53–56 (1970); J. B. Cotton, *Chem. Eng. Prog.*, vol. 66, No. 10, pp. 57–62 (1970); T. Koizumi et al., *Corrosion and Corrosion Control*, pp. 318–323 (J. Wiley & Sons 1973); *Titanium Science and Technology*, vo. 4, pp. 2383–2393 (1973); L. C. Covington, *Titanium Science and Technology*, vol. 4, pp. 2395–2403 (1973).

Oxyanions ($SO_4^{2-}$, $NO_3^{1-}$, $CrO_4^{2-}$, $PO_4^{3-}$ and $CO_3^{2-}$) have been found to inhibit pitting of titanium in certain systems containing halide ions. See, e.g., T. Koisumi, et al., supra at pp. 2388–2392. Also, NaBr has been found to inhibit titanium corrosion in fuming nitric acid. See I. Ya. Klinov, supra at p. 87. However, the addition of such chemical agents of the offending corrosive liquid modifies process stream compositions and can lead to processing difficulties.

Alloying methods have been developed which provide corrosion protection without the disadvantages of such anticorrosion agents. However, alloying is time-consuming and expensive, and is impracticable for protection of existing chemical process apparatus. Moreover, Ti alloys are themselves not completely resistant to corrosion attack by strong acid media, as is acknowledged in U.S. Pat. No. 3,457,103.

Thus, for example, M. Stern, et al., *J. Electrochem. Soc.*, vol. 19, No. 9, 755–759 and 759–764 (1959) observed corrosion of alloys of Ti and Pd, Pt, Pd, Rh, Ru, Ir, Os, Re or other metals in contact with boiling 10% HCl. Stern et al. also noted that the Ti in Ti-noble metal alloys corrodes at an accelerated rate when first placed in contact with a corrosive liquid and that the Ti continues to corrode until the atomic ratio of noble metal to Ti on the surface increases.

See also Kolyada et al., 88 Chem. Abs. 93630k (1978) (Ti alloys containing Rh and Y). Keinina, et al., 84 Chem. Abs. 8149y (1976) used Rh—Ti alloys as electrodes in the electroreduction of organic compounds. Eremenko, et al., 79 Chem. Abs. 10422j (1973) studied phase diagrams of Ti—Rh alloys.

Ti has been suggested as a suitable material of construction in manufacture of boiling nitric acid in contact with Pt—Rh alloy catalyst. Roy et al., 89 Chem. Abs. 9380p (1978). S. Z. Kostic et al., *Br. Corros. J.*, vol. 9, No. 4, 211–215 (1974), in earlier work, also found tested Ti alloys to be passive in $HNO_3$ solutions in contact with Pt—Rh alloy catalyst, although these researchers noted that while the Ti in such a catalytic system remained in the passive region, the corrosion potential of the Ti shifted toward more positive values, i.e., moved toward a less passive state and, hence, closer to an active corrosion region.

In view of the various problems presented by use of alloys and anticorrosion agents, the development of a method whereby titanium could be quickly and readily provided with a substantially impervious coating would be very desirable.

It is known that the platinum-group metals are highly resistant to corrosion by most acids, with the relative corrosion resistance of these noble metals being $Rh \approx Ir > Pt > Pd > Ru \approx Os$. *Corrosion*, vol. 1, chapter 6 (L. L. Shreir, Ed. 1963).* Coatings of these metals have been used to protect substrate metals such as copper, brass, bronze, Ni, Ag, Au and Pt from corrosion. However, the effectiveness of such coatings depends not only on the ability of the coating metal to resist corrosion, but also on the avoidance of any galvanic corrosion between the base metal and the noble metal coating. Thus, rhodium is generally not plated directly over steel, zinc, aluminum, lead, tin and most tin-lead alloys; this group of base metals generally requires substantially non-porous undercoatings of copper, nickel or silver first be applied, since the inevitable development of pinholes in the rhodium coating, would, if the underlying metal were left exposed, be subject to corrosion of the base metal. Moreover, a known disadvantage of rhodium coatings is a high internal tensile stress which can give rise to cracking in deposits thicker than 0.1 mil. C. G. Fink, et al. *Trans. Electrochem. Soc.*, vol. 63, pp. 181–186 (1933); E. H. Laister, et al., Trans. *Inst. Metal Finishing*, vol. 29, pp. 1–22 (1953); J. M. Hosdowitch *Surface Protection Against Wear and Corrosion*, pp. 52–55 (Amer. Soc. for Metals 1954); E. A. Parker, *Plating*, vol. 42, pp. 882–892 (1955); F. H. Reed, *Trans. Inst. Metal Finishing*, vol. 36, pp. 74–81 (1959); R. R. Benham, *Platinum Metals Rev.* 5(1), pp. 13–18 (1961); R. H. Atkinson, *Modern Electroplating*, pp. 310–325 (John Wiley & Sons, Inc. 1963); *Corrosion*, vol. 2, pp. 14.100–14.103, (L. L. Shreir, Ed. 1963). Exemplary of processes for providing the rhodium coatings of the prior art are the brushplating process disclosed in C. D. Hughes, *Trans. Inst. Met. Finishing*, vol. 33, pp. 424,439 (1956) and the electrodeposition processes of U.S. Pat. Nos. 1,949,131 and 1,981,820.

* See alsoM. Stern et al., supra at p. 760.

Dimensionally stable titanium anodes having coatings containing rhodium have been prepared by methods which require the anodes to be heated to a high temperature which acts to either oxidize the Rh-surface to form a protective layer over the Ti or to cause the Rh to diffuse into the surface of the Ti substrate metal, in effect forming a Rh—Ti alloy at the surface. However, the requirement of heat treatment using such high temperatures imposes considerable economic penalties, especially on one who seeks to protect existing chemical process apparatus or to manufacture large scale titanium equipment such as distillation towers and the like. As to the preparation of such anodes, see German Pat. No. 2,200,527, as cited in 77 Chem. Abs. 134,374 (1972) (Rh—Ru alloy layer); German Pat. Nos. 2,136,391 and 2,136,394, as cited in 76 Chem. Abs. 93908j and 93909k (1972), respectively (Rh—W and Rh—Te complex oxides); German Pat. No. 2,163,257, as cited in 77 Chem. Abs. 108,851g (1972) (sequential Rh and Rh—Ru layers); German Pat. No. 2,233,485, as cited in 78 Chem. Abs. 105,435j (1973) (complex Rh—Sb/Nb/Ta—Ru/Ir oxides); U.S. Pat. No. 3,801,490, as cited in 80 Chem. Abs. 152,139s (1974 (Bi—Rh oxides); O. Suzuki et al., 80 Chem. Abs. 66,206e, 66,207f, 66,208g, 66,209h and 66,210b (1974) (Ru-noble metal alloy coatings); and German Pat. No. 2,331,959, as cited in 80 Chem. Abs. 103,267y (1974) (mixed Ru, Ir, Rh and Pd oxides).

In the absence of such heating steps Rh-coated Ti anodes exhibited unpredictable corrosion properties. For example, M. Antler et al., 5 Electrochem. Tech. 126–130 (1967), 66 Chem. Abs. 101070r (1967) tested rhodium coated Ti anodes in the electrolysis of chloride and chloride-chlorate solutions and found corrosion films to develop which were not self-limiting and which spread under the rhodium coatings, which were themselves found to have detectable porosity. Also, the uncoated parts of the Ti anodes were corroded. S. P. Antonov, et al., 78 Chem. Abs. 78,899e (1973) studied the effectiveness of Ti and other metals as anode substrates for depositing thin-layer coatings of Pd, Rh, Pt and $PbO_2$, which were applied after degreasing and etching of the selected substrate, and observed increased corrosion resistance in $H_2SO_4$—$Cr(SO_4)_3$ and $H_2SO_4$—$ZnSO_4$ media.

However, the foregoing methods employed for preparation of titanium anodes are not readily adaptable to preparation of titanium substrates which are intended for use in non-electrolytic environments. The art has heretofore required titanium articles which are coated with rhodium to be prepared via methods which employ a high temperature heating step. Thus, in Japanese Patent Publication 71/12,882, as cited in 76 Chem. Abs. 89,375r (1972) titanium articles were etched, dipped into noble metal salt solutions and then plated by heating of the surface at 600° C. for one hour. Similarly, Japanese Kokai No. 73/25,636, after activating the titanium surface, dipped the titanium article into a solution containing the selected rhodium salt and then heated the treated article to a temperature above the decomposition temperature of the precious metal salt to effect diffusion of the noble metal into the surface of the titanium and thus created a rhodium-titanium alloy on the surface of the metal. Japanese Kokai No. 78/26,234, as cited in 89 Chem. Abs. 82,148d (1978) required heating of the rhodium plated article at a temperature of 600° C. in air to form a rhodium oxide layer. Again, these methods are severely uneconomic and impracticable for protecting existing titanium equipment and are also only with great difficulty in fabrication of large, industrially-used chemical process apparatus. Moreover, Japanese Kokai No. 73/25,636 suggests, even though no working example to rhodium-coatings is presented, that corrosion will result even if such a heating step is used, since the Kokai's examples showed that a Pd coated Ti article, when exposed to a 5% boiling HCl solution, corroded at the rate of 0.32 mm/year, i.e., 12.6 mil/year, after only 8 hours of exposure.

SUMMARY OF THE INVENTION

According to the process of the present invention, the rate of corrosion attack upon metal surfaces of titanium and titanium alloys by strong acid media is decreased by coating at least a portion of the metal surface with rhodium metal. In accordance with one embodiment, at least a portion of the titanium metal is electrolytically coated with an effective amount of the rhodium metal. The discovery that a rhodium coating effectively inhibits the corrosion attack upon titanium and titanium alloys by strong acid media is highly surprising since other noble metals, Pd, Pt, Ir and Ru, which are either generally alloyed with Ti or coated on other metals to form corrosion-resistant surfaces have been found not to provide a coating on Ti which is sufficiently long-lived for industrial application. Rhodium, therefore, has been surprisingly found to be unique in its ability to provide a long-lived, corrosion resistant coating on titanium substrates. The unique effectiveness of Rh was quite unpredictable, and we are unable to offer any definite theory to explain this uniqueness. Indeed, the superior performance of Rh over other tested noble metals is contrary to the belief of the prior art that iridium and rhodium generally exhibit a similar degree of corrosion resistance. In our coatings on Ti we have found that Ir is not equivalent to, but is greatly inferior than, Rh.

It has also been surprisingly found that coating even a very small portion of a titanium metal article surface with rhodium provides corrosion protection to the entire article, including the uncoated portions. Thus, as little as 1% of the surface area of the titanium has been coated to provide corrosion protection. The effectiveness of such partial coatings of rhodium is made all the more surprising by the failure of other tested noble metals (Ru, Pt, Pd, Ir) to adequately protect titanium surfaces even when the surfaces are completely coated with these other noble metals.

The process of this invention provides a substantially non-corrosive metal surface, and allows existing apparatus to be protected against corrosion, avoiding the expensive alternative of replacing the corroding apparatus with one fabricated of a different, corrosion resistant material. The process of this invention also provides a corrosion-resistant surface without the need to chemically modify the offending corrosive liquid medium. Finally, the long-lived rhodium-coatings of this invention can be electrolytically applied to titanium surfaces without the need to first undercoat the titanium with other metals (e.g., Cu, Ni or Ag), which undercoating techniques have been frequently employed in the prior art for substrate metals, and the long-lived coatings of this invention result without the need to expose the coated article to high temperatures prior to use of the article in contact with the strong acid media.

Thus, the present invention provides novel substantially non-corrosive titanium materials of construction for chemical process apparatus intended for use in contact with strong acid media in the substantial absence of externally applied, anodically polarizing voltage to the said materials of construction, said materials comprising titanium or a titanium alloy having a coating of metallic rhodium over at least 1% of the surface of said materials which is intended for use in contact with said strong acid media, said materials, following the application of said metallic rhodium coating, being exposed to temperatures of less than 400° C.

DETAILED DESCRIPTION OF THE INVENTION

The present invention provides substantially decreased rates of corrosion of titanium and titanium alloys when surfaces of these alloys are employed in contact with strong acid media.

The term "strong acid media", as used herein, is intended to refer to aqueous solutions containing any of the strong mineral acids, strong carboxylic acids or acid salts of the foregoing, which, in solution, liberate the free acid, and mixtures thereof. These media are severely corrosive to titanium and its alloys, that is the media will attack the metal surfaces at a rate of at least about 100 mpy, more typically at least about 200 mpy (1 mpy=0.001 in/yr). Thus, the strong acid media can comprise aqueous solutions of sulfonic acids, nitric acid, sulfuric acid, hydrochloric acid, hydrofluoric acid, hydroiodic acid, hydrobromic acid, phosphoric acid, formic acid, acetic acid, oxalic acid, chromic acid, and mixtures thereof such as aqua regia and chromosulfuric acid. Typical organic derivatives of the foregoing acids which liberate the acid in solution are the water soluble halo-substituted, and especially bromo-, iodo- and chloro-substituted, polyols, ethers, esters and the like, e.g., (using, as illustrations, halogenated analogues of ethylene glycol and propylene glycol and their esters and of diethylene glycol and dipropylene glycol and their esters): ethylene dibromide (1,2-dibromoethane); ethylene bromohydrin (1-bromoethan-2-ol); bromoethyl acetate (1-acetoxy-2-bromoethane); diethylene glycol dibromide (2,2'-dibromo-diethylether); 2-bromo-2'-hydroxy-diethyl ether; 2-bromo-2'-acetoxy-diethyl ether; ethylene glycol acetate bromoacetate; diethylene glycol acetate bromoacetate; 1,2-dibromopropane; 1-bromopropan-2-ol; 2-chloropropan-1-ol; 1-bromo-2-acetoxypropane; 2-bromo-1-acetoxypropane; 1,1'-dibromo di-n-propylether; 2,2'-di-bromo-di-n-propyl ether; 1,2'-dibromo-di-n-propyl ether; 1-iodo-1'-acetoxy-diisopropyl ether; 2-bromo-1'-acetoxy-diisopropyl ether; 1-acetoxy-isopropyl-2'-bromo-n-propyl ether; 2-bromoethyl-1-bromo-propyl ether; ethylene glycol bromoformate; diethylene glycol bromohydrin; ethylene glycol formate bromoformate; diethylene glycol formate bromoformate; vinyl bromide; ethylene glycol iodo acetate; diethylene glycol bromoformate; and the like.

The strong acid media can also optionally contain an organic solvent which can be polar or nonpolar. Typical polar organic solvents include carboxylic acid esters such as the lower alkyl esters of lower alkanoic acids (e.g., methyl acetate), ethers such as tetrahydrofuran and p-dioxane, dimethyl ethers of diethylene glycol and of triethylene glycol, alcohols such as t-butyl alcohol and methanol, ether alcohols such as polyglycols, nitriles such as acetonitrile and propionitrile, amides such as dimethyl formamide and dimethyl acetamide, ketones such as acetone, methyle ethyl ketone and diethylketone, polar chlorinated hydrocarbons such as chloroform, as well as dimethyl sulfoxide, and the like, as well as alkoxylated ester derivatives of the foregoing ethers and esters such as, for example, ethylene glycol acetate acetoxy acetate ($H_3C(O)COCH_2CH_2OC(O)CH_2OC(O)CH_3$), and diethylene glycol acetate acetoxy acetate. Non-polar solvents include the hydrocarbons such as benzene and the alkanes (e.g., hexane) and chlorinated hydrocarbons such as carbon tetrachloride.

The strong acid media will be generally characterized by a pH of less than about 2, more typically less than about 1, as determined employing a combination glass electrode provided with a Calomel reference electrode.

The process of this invention is particularly suited to protection of metal surfaces which are intended for use in contact with aqueous solutions of hydrohalic acids (e.g., HCl, HBr, HI, HF and the like), lower alkanoic acids (e.g., acetic acid, formic acid, isobutyric acid and the like), sulfonic acids (e.g., benzene sulfonic acid, toluene sulfonic acid and the like) and mixtures of the foregoing.

The term "decreased rate of corrosion" as used herein is intended to refer to the relative rates of corrosion of the titanium and titanium alloy metal surfaces by the strong acid media measured both with and without the use of the process of this invention. Desirably, the present invention achieves a rate of corrosion of less than about 20 mpy (1 mpy=0.001 in/yr.), preferably less than about 10 mpy, and more preferably less than about 1 mpy. Most preferably the rate of corrosion is essentially zero, as measured employing any technique having an accuracy of ±0.5 mpy. Obviously, the foregoing absolute rates of corrosion, and decreases in original corrosion rate, are values which will vary widely depending on the nature of the strong acid media, the specific alloy, if any, of titanium, the anticorrosive agent and its levels used, temperature and a wide variety of other factors. Also, the rate of corrosion which can be tolerated in a given application will usually be largely based on economical considerations.

Preferably, when the titanium or titanium alloy article treated in accordance with the process of this invention is contacted with a strong acid medium, the strong acid medium is characterized as passive (i.e., substantially non-corrosive) as determined by the anodic polarization curve generated by potentiodynamic polarization analysis employing the Method G 5-72, American Society for Testing and Materials Standards, Part 10, Pages 660–670 (1975).

The titanium alloys whose corrosion can be inhibited by the process of this invention are those alloys which contain titanium as the predominant metal, preferably alloys containing at least 50 weight percent of the alloy is Ti, and which can also include up to about 30% of, for example, such other metals as Al, V, Mo, Pd, Pt, Ni, Cr, Fe, Sn, Mn, Zr, Cb, Ta and the like. Typical titanium alloy compositions are set forth in Table I. The compositions of other typical alloys can be found in the *Metals Handbook*, 8th Ed., Vol. 1, pp. 1147–1156 (1961) published by the American Society for Metals, which is hereby incorporated by reference.

TABLE 1

| | TITANIUM ALLOYS | | | | | |
|---|---|---|---|---|---|---|
| | Alloy Composition (Wt %)* | | | | | |
| Element | Ti-50A | Ti-6A1-4V | Ti-Pd | Ti Code-12 | Ti-140A | Ti-155A |
| Nitrogen, Max. | 0.03 | 0.05 | 0.03 | 0.03 | 0.05 | 0.05 |
| Carbon, Max. | 0.10 | 0.10 | 0.10 | 0.08 | 0.08 | 0.08 |
| Hydrogen, Max. | 0.015 | 0.015 | 0.015 | 0.015 | 0.015 | 0.0125 |
| Iron, Max. | 0.30 | 0.40 | 0.30 | 0.30 | 2.0 | 1.4 |
| Oxygen, Max. | 0.25 | 0.20 | 0.25 | 0.25 | — | — |
| Aluminum | — | 5.5/6.75 | — | — | — | 5.0 |
| Vanadium | — | 3.5/4.5 | — | — | — | — |
| Palladium | — | — | 0.12/0.25 | — | — | — |
| Molybdenum | — | — | — | 0.2/0.4 | 2.0 | 1.2 |
| Nickel | — | — | — | 0.6/0.9 | — | — |
| Chromium | — | — | — | — | 2.0 | 1.4 |
| Titanium | remainder | remainder | remainder | remainder | remainder | remainder |

*Compositions are nominal, not by analysis.

It has been surprisingly found that it is not necessary, in order to protect a given titanium or titanium alloy metal surface, that the entire surface be coated with the rhodium. Rather, providing a coating of rhodium on at least about 1% of the surface area of the titanium metal surface has been found to render substantially non-corrosive both the portion of the surface over which the coating is made as well as the portion of the surface over which no coating has been formed. Preferably, at least 2%, and most preferably at least 5%, of the surface area of the titanium metal surface is covered by a rhodium coating in accordance with the process of this invention.

Nor is it a requirement that the coated portions of the metal surface be contiguous, and the coated surfaces can be scattered over the article which is treated, so long as the total of the coated surfaces exceeds the minimum percentage of the total metal surface which is desired to be protected. The rhodium-coated portions of the titanium article's surface are preferably substantially uniformly distributed over the entire surface to be protected. For example, in protecting a Ti distillation tower, the rhodium-coated portions can comprise evenly spaced-apart, circumferentially positioned bands of Rh-coated surfaces or evenly spaced "spots" of Rh-coated surfaces on the tower's interior walls.

That a non-uniform coating is also effective in reducing corrosion is wholly surprising and unpredictable. The efficacy of a non-uniform coating thus means that it is not necessary to avoid the presence of pinholes in the rhodium coating.

The rhodium coating on the titanium or titanium alloy metal surface can be provided by any convenient means. Thus, the article can be electrolytically coated with the rhodium, or the titanium article can be brought into intimate physical contact with rhodium metal, such as by use of fastening devices to join the rhodium metal to the titanium surface to be protected. Likewise, any other convenient technique of applying the rhodium metal coating can be used, with the conventional methods of mechanical metal atomization employed in the aircraft industry being an example. The term "metallic rhodium coating" as used herein, therefore, will be understood to include coatings which are applied to chemical, electrolytic or physical methods to the titanium article.

According to one embodiment of the process of this invention, the metal surface to be coated is subjected to an electrical potential so as to cause atoms of rhodium metal to be applied to the metal surface.

The method by which the electrolytic deposition of rhodium on the titanium metal surface is accomplished is not at all critical to the practice of this invention. Thus, any conventional method in which the titanium metal surface is cathodically polarized can be used, and any suitable material, such as platinum, can be employed as the anode. For example, a cathodically polarized metal surface of titanium or its alloy can be suspended in a suitable electrolysis medium containing a soluble rhodium source and in which is also placed an anode to cause a current to flow between the electrodes so as to electrolytically deposit rhodium metal from the electrolysis medium onto the metal surface of the titanium cathode. A particularly preferred embodiment of electrolytic deposition of rhodium is the use of a cathodically polarized applicator, such as a sponge or other porous body provided with suitable conductive material and having absorbed therein or adsorbed thereon the selected liquid electrolysis medium containing the rhodium source. This applicator is anodically polarized and then brought into contact with the metal surface to be treated, which is cathodically polarized, to cause an electric current to flow between the applicator and the metal surface so as to deposit rhodium metal atoms as a coating onto the portion of the metal surface which is brought into contact with the applicator. This embodiment is particularly suited for the treatment according to this invention of metal surfaces of existing equipment, such as the interior surfaces of chemical processing apparatus. A conventional brush-plating method is described in H. D. Hughes, *Trans. Inst. Metal Finishing,* vol. 33, pp. 424–439 (1956).

The titanium metal surfaces upon which the rhodium is to be electrolytically deposited are preferably first cleaned to remove substantially all grease, organics and dirt which may be on the surface. Such degreasing and cleaning can be accomplished by conventional methods, as for example by use of a nonmetallic abrasive treatments and/or conventional degreasing solvents, followed by a water wash. These cleaning methods are known and their description is not critical to an understanding of the present invention.

The source of the rhodium metal in the electrolysis medium is not critical, but will generally comprise a rhodium-containing compound or complex at least partially dissolved in the liquid electrolysis medium. Thus, any inorganic or organic rhodium complex or compound which provides cations of rhodium in any of its positive valence states, e.g., $Rh^{2+}$, $Rh^{3+}$ or $Rh^{4+}$, most preferably $Rh^{3+}$, can be used.

Exemplary of suitable inorganic rhodium compounds are the rhodium halides (e.g, $RhBr_3$, $RhBr_4$, $RhBr_3$, $RhCl_3$, $RhCl_2$, $RhF_3$, $RhI_3$, $RhI_2$, $RhCl_4$, and the like), the rhodium oxides (e.g., $RhO_2$, $Rh_2O_3$, RhO, and the like), $Rh_2(SO_4)_3$, $RH(HS)_3$, RhS, $Rh_2S_3$, $[Rh(NH_3)_6]Cl_3$, $Rh(SO_3)_3.6H_2O$, $[Rh(H_2O)_6](ClO_4)_3$, $Rh(NO_3)_3$—.$2H_2O$ and the like. Exemplary of suitable organic rhodium compounds are the rhodium salts of monocarboxylic acids of 1 to 8 carbon atoms and preferably of 1 to 4 carbon atoms (e.g., $Rh(O_2CHCH_3)_4$, $Rh(O_2CHCH_2CH_2CH_3)_4$, $Rh(O_2CHCH_2CH_3)_4$ and the like), rhodium alkoxides having a total of from 2 to 10 carbon atoms (e.g., $Rh(OCH_3)_4$, $Rh(OC_2H_5)_4$ and the like), rhodium phenoxide and the like. Mixtures of the foregoing can also be used.

Preferred sources of rhodium cations are inorganic compounds of $Rh^{3+}$, e.g., the oxide and halides. Most preferred Rh sources are $RhCl_3$, $RhBr_3$, $Rh_2O_3$, $RhI_3$, and $RhF_3$.

The amount of rhodium source which should be employed in the liquid electrolysis medium will vary widely, but should generally be sufficient to provide the Rh cation in the liquid electrolysis medium in a concentration of at least about 0.01 mmol per liter, preferably at least about 0.1 mmol/liter, and more preferably at least about 1.0 mmol/liter. The maximum amount of selected rhodium source is solely a question of economics and solubility in the selected liqud electrolysis medium.

The selected source of rhodium can be introduced into the liquid electrolysis medium by any of several means, none of which are critical to this invention. Thus, the rhodium source can be added as a solid or as a solution containing the rhodium source, and can be admixed with the liquid electrolysis medium before or during the application of a potential to the titanium or titanium alloy metal surface to be treated.

The liquid electrolysis medium should, of course, contain a solvent for the rhodium source, although complete dissolution of the rhodium source is not required. While the solvent is preferably also one which is not corrosive to the titanium or titanium alloy metal surface to be treated, the period of time over which the untreated metal surface is in contact with the liquid electrolysis medium limits the degree of corrosive attack of any corrosive liquid medium if employed as solvent and does not make this an essential requirement of the solvent. The solvents employed in this invention should, of course, also be electrolytically conductive when the rhodium source is dissolved therein. Preferred solvents are aqueous solutions of the strong mineral acids, e.g., the hydrohalic acids, sulfuric acid, nitric acid and the like, and most preferably aqueous solutions of HCl or HBr.

The degree of polarization, and the method by which the polarity is developed and maintained, in the electrolytic coating of rhodium by this invention is not critical, and can be readily determined by routine experimentation. Generally, a potential of from about 0.2 to 10 volts, and preferably from about 0.5 to 5 volts, will be sufficient. While greater than 2 volts can be used, a reduced efficiency in the electrodeposition of the rhodium can result. Similarly, the amount of electrical current which should be passed through the metal surface to be coated is not critical and will vary widely depending on such factors as the thickness of the rhodium coating desired, the precise rhodium source employed and other factors. These electrolysis parameters can be readily ascertained using the following well-known equation (I), derived from Faraday's Law:

$$H = \left[\frac{C \times t}{e \times 96487}\right][M/\gamma] \quad \text{(I)}$$

wherein "H" is the desired thickness of the rhodium metal coating, "C" is the current density applied during electrolysis, "t" is the time of the electrolytic deposition of the rhodium on the metal surface, "e" is the valence change which each atom of rhodium salt undergoes in forming one atom of rhodium metal, "M" is the molecular weight of rhodium, and "γ" is the specific gravity of metallic rhodium, all in consistent units. Thus, if a rhodium coating of $2\times10^{-5}$ cm (i.e., about 0.008 mil) thickness is desired on a metal surface of 1 $cm^2$, then the current density required, using a $Rh^{3+}$ compound as the rhodium source and an electrolysis time ("t") of 1 minute, is $$2 \times 10^{-5}\text{cm} = \left[\frac{C \times (\frac{1}{60})\text{ hour} \times \frac{3600\text{ coul}}{\text{amp. hour}}}{3\text{ coul} \times 96487}\right]\left[\frac{103\text{ gm/gm-mol}}{12.4\text{ gm/cm}^3}\right]$$

or $$C = \frac{(0.02)(3)(96487)(12.4)(60)(10^{-3})}{(3600)(103)}$$

$$C = 11.6 \times 10^{-3}\ \frac{\text{amp}}{\text{cm}^2}$$

The electrolytic deposition of rhodium according to this invention can be accomplished over a wide range of temperatures, and temperature is not a critical operating parameter for this invention. Generally, the rate of deposition of rhodium on titanium and its alloys will increase with increasing temperature. The electrolytic rhodium application will therefore generally employ temperatures of between the freezing point and boiling point of the liquid electrolysis medium and more preferably from 20° to 80° C.

The time of electrolytic deposition of rhodium according to this invention is also not critical, can be easily ascertained from equation I above, and will vary with the thickness of the rhodium coating which is desired, the source of rhodium which is selected for use in the electrolysis, the current density and a variety of other factors.

The current density will generally range from about 0.1 milliamps/$cm^2$ to 2 amps/$cm^2$, and preferably from about 1 to 50 milliamps/$cm^2$. Current densities of less than about 0.1 milliamps/$cm^2$ can be used but tend to be uneconomic.

In accordance with a second embodiment of this invention, the surface of the titanium-containing article which is desired to be coated can be brought into intimate contact with a rhodium metal surface. The rhodium metal surface can be attached by any convenient means to the titanium article, such as by use of bolts, welds or other techniques. The form of the rhodium metal surface which is used is not critical, but is preferably one which conforms to the surface contour of the portion of the titanium surface which is to be contacted. As has been mentioned above, it is not necessary that the rhodium coating be contiguous. Obviously, therefore, bolts, rivots or other devices fashioned partially or completely of rhodium can be placed in contact with a titanium article to be protected. In such a case, it is only necessary that the total surface area of the titanium is contacted with the rhodium-fabricated devices be in excess of 1% for most efficient protection of the entire titanium article.

The thickness of the rhodium coating on the metal surface to be protected is also not critical to the process of this invention, although the rhodium coating will generally vary in thickness from about 0.0001 to 1 mil, and preferably from about 0.001 to 0.1 mil. Similarly, while rhodium thicknesses of greater than about 1 mil can be used, they are generally uneconomical due to the relative cost of the additional rhodium required.

The conditions of temperature and pressure under which the rhodium coated titanium metal surface of this invention should be used is not critical. Generally, however, these coated surfaces will contact a strong acid media at temperatures or less than about 300° C., preferably less than about 250° C., and more preferably less than about 200° C. The pressure employed is limited only by the structural strength of pressurized vessels which are used and is not a parameter affecting the use of the coated titanium metals of this invention.

The rhodium-coated titanium (or Ti alloy) article produced by the process of this invention should be employed in the substantial absence of anodically polarizing, externally-applied voltage to the coated article, that is, the article should not be used as an anode with an externally applied voltage, which anodically polarizes the article. Preferably, any such voltage is less than about 1 volt. Such externally applied anodic polarization of the Rh-coated Ti article adversely affects the corrosion resistant properties of the articles and is therefore undesirable. Preferably, the coated article during use is not subjected to current densities in excess of about 0.0001 amp/cm$^2$.

As has been pointed out above, it has been surprisingly found that it is not necessary in order to achieve the desired anti-corrosive properties to subject the titanium (or titanium alloy) articles during the preparation of the coated article in accordance with this invention to such high temperatures as have been employed by the prior art. Thus, as when an electrolytic technique is employed to form the rhodium coating, the titanium or titanium alloy article will be generally exposed only to a temperature of between the freezing point and a boiling point of the liquid electrolysis medium, more preferably from 20° to 80° C., as has been pointed out above. Moreover, the extreme high temperatures employed by the prior art are not generally experienced by the articles prepared by this invention during their use in service in contact with the strong acid media, and, as has also been pointed out above, the coated surfaces of the articles will generally contact the strong acid media at temperatures of less than about 300° C.

The process of this invention can be further illustrated by reference to the following examples, wherein parts are by weight unless otherwise indicated. The potentiodynamic polarizat/on test apparatus used in the examples is manufactured by Princeton Applied Research (Model 331-1). The Ti-50A coupons used in Examples 1–8, 11, 12 and 15–19 are manufactured by Corrosion Test Supplies company (Baker, Louisiana), and comprise two 20×20×15 mm coupons which are welded end to end to form the 20×40×1.5 mm coupons which are tested. The Ti-50A coupons used in Examples 9, 10, 13, 14 and 20 are cylindrical, unwelded rods having a diameter of 1 cm and an external surface area of 5 cm$^2$. The pH of each strong acid medium in the Examples is less than 2.

EXAMPLE 1

Preparation of Rh-Coated Ti Coupon

There is charged to a 250 cc glass beaker, provided with a platinum anode and a cathode comprising a 40×20×1.5 mm coupon of Ti-50A titanium metal having the composition set forth in Table I above, 0.1 liter of a liquid mixture containing 0.81 gram of $RhCl_3.3H_2O$ and 30 grams HCl. The coupon is fully immersed in the liquid. The temperature of the liquid is raised to 60° C. by means of a thermostated water bath, and a variable DC power source is then used to effect a current flow between the two electrodes, employing a current density of 10 ma/cm$^2$, which current is maintained for a period of about one minute and is measured by means of an ammeter connected in series. After this treatment period, the treated coupon is determined to have deposited thereon a substantially uniform rhodium metal coating of about 0.01 mil in thickness.

EXAMPLE 2

A rhodium-coated coupon prepared as in Example 1 is then treated in separate runs as follows: 400 milliliters of a liquid mixture containing 70.6 weight percent acetic acid, 6.6 weight percent formic acid, 15.6 weight percent water, 0.7 weight percent ethylene glycol diacetate, 3.3 weight percent HBr and 3.2 percent ethylene glycol bromoacetate is charged to a 500 cc glass flask provided with a gas sparger and a reflux condenser. The coupon to be tested is suspended in the liquid by means of a ¼ inch wide Teflon TM tape which is attached through a 1/16" diameter hole centrally positioned in the 20×40 mm face of the coupon. The flask is sealed and nitrogen is sparged through the liquid at a rate of about 2 cc per minute. The flask is then heated from room temperature to boiling, and the boiling temperature is maintained for the selected period of time. The nitrogen gas sparging is continued throughout the heating period.

At the end of each run, the coupon is removed from the vessel, and its weight and dimensions are measured (to an accuracy of $\pm 10^{-5}$ grams; ±0.5 mm) to determine the rate of corrosion of the coupon. Each run employs a fresh liquid mixture having the above composition. The data thereby obtained are set forth in Table II below.

Table II

| Run No. | Temp. (°C.) | Run Time (hrs.) | Total Exposure Time of Coupon (hrs.) | Rate of Corrosion (mpy)* |
|---|---|---|---|---|
| 1 | 103 | 67 | 0–67 | 1 |
| 2 | 103 | 91 | 67–158 | 0 |
| 3 | 103 | 90 | 158–248 | 1 |
| 4 | 103 | 95 | 248–343 | 0 |

*1 mpy = 0.001 inch/yr.

At the end of the 343 hours, the rhodium-coated titanium coupon is observed to show no evidence of corrosion. Analysis of the liquid remaining at the end of each run shows no detectable amount of rhodium to be present in the liquids (employing a technique of analysis sensitive to a Rh level of 0.1 ppm), thereby indicating that the rhodium does not dissolve from its coating on the titanium coupon during contacting with the highly corrosive liquid.

EXAMPLE 3 FOR COMPARISON

The procedure of Example 2 is repeated except that the Ti-50A coupon which is subjected to the corrosion testing is not coated with any rhodium material. At the end of 124 hours of contact in the boiling liquid medium, employing a temperature of about 110° C., the Ti-50A coupon is found to have suffered a corrosion rate of 235 mpy and observation of the coupon shows evidence of hydriding, thereby indicating severe corrosion.

EXAMPLE 4 FOR COMPARISON

Following the procedure of Example 2, a Ti-50A coupon, which has a substantially uniform coating (to a thickness of 0.38 mil) (1 mil=0.001 in.) of elemental palladium, is suspended in the boiling acidic medium, the data thereby obtained are set forth in Table III below.

Table III

| Run No. | Temp. (°C.) | Run Time (hrs) | Total Exposure Time of Coupon (hrs) | Rate of Corrosion (mpy) | Pd in Solution (ppm) |
|---|---|---|---|---|---|
| 1 | 109 | 79 | 0–79 | 1 | 4.3 |
| 2 | 109 | 46 | 79–125 | 3 | 18 |
| 3 | 109 | 139 | 125–264 | 1 | 4.7 |

Thus, while the palladium-coated coupon of the titanium alloy exhibits a low rate of corrosion over the 264 hours of exposure to the boiling acidic medium, analysis of the corrosive liquid at the end of each run shows significant levels of palladium cation (reported as Pd metal) to be dissolved therein, thereby indicating that the palladium is dissolved from the surface of the coated coupon is significant amounts.

EXAMPLE 5 FOR COMPARISON

Following the procedure of Example 1, a platinum-coated Ti-50A coupon is prepared by contacting a Ti-50A coupon with 100 ml. of a solution containing 2 grams of $H_2PtCl_6$ and 30 grams HCl in water, employing a temperature of 65° L C. and a current density of 10–15 ma/cm$^2$ for a period of 30 seconds, to yield a substantially uniform platinum metal coating of about 0.01 mil. in thickness.

Exposure of the platinum-coated coupon thereby obtained to an acidic liquid medium as in Example 2 yields the data set forth in Table IV.

Table IV

| Run No. | Temp. (°C.) | Run Time (hrs) | Total Exposure Time of Coupon (hrs) | Rate of Corrosion (mpy) |
|---|---|---|---|---|
| 1 | 110 | 85 | 0–85 | 1 |
| 2 | 110 | 101 | 85–159 | 194 |

After the 159 hours of treatment with the corrosive liquid, the platinum-coated coupon is observed to be severely etched and to also exhibit possible hydriding. Thus, after 159 hours, the platinum-coated titanium alloy coupon exhibits an unacceptable rate of corrosion in contact with the acid medium.

EXAMPLE 6 FOR COMPARISON

Following the procedure of Example 1, a ruthenium-coated Ti-50A coupon is prepared by contacting a Ti-50A coupon with 100 ml. of an aqueous solution containing 1.0 gram ruthenium-trichloride and 30 grams HCl, thereby yielding a substantially uniform ruthenium metal coating of about 0.01 mil in thickness.

Exposure of the ruthemium-coated coupon thereby obtained to an acidic liquid medium as in Example 2 yields the data set forth in Table V.

Table V

| Run No. | Temp. (°C.) | Run Time (hrs) | Total Exposure Time of Coupon (hrs) | Rate of Corrosion (mpy) |
|---|---|---|---|---|
| 1 | 110 | 80 | 0–80 | 0.4 |
| 2 | 110 | 85 | 80–165 | 135 |

Therefore, after 165 hours, the ruthenium-coated titanium alloy coupon exhibits a non-acceptable rate of corrosion in contact with the acid medium.

EXAMPLE 7 FOR COMPARISON

Following the procedure of Example 1, an iridium-coated Ti-50A coupon is prepared by contacting a Ti-50A coupon with 100 ml. of an aqueous solution containing 1.5 grams iridium trichloride and 30 grams of HCl, thereby yielding a substantially uniform iridium coating of about 0.02 mil. in thickness.

Exposure of the iridium-coated coupon thereby obtained to an acidic liquid medium as in Example 2, employing a temperature of 110° C., reveals that the coupon corrodes at a rate of 175 mpy after 90 hours of exposure, which is an unacceptable rate of corrosion.

EXAMPLE 8

A 1 cm-diameter rod composed of Ti-50A alloy and having a 5 cm$^2$ surface area is completely coated with rhodium following the procedure of Example 1 except that 0.1 liter of an aqueous solution containing 0.81 gram of $RhCl_3.3H_2O$ and 30 milliliters of HCl is used. A temperature of 60° C. is employed, together with a current density of 10 ma/cm$^2$ for a period of about one minute. The rhodium-coated rod thereby produced is found to contain deposited thereon about 0.01 mil of rhodium metal as a substantially uniform coating.

EXAMPLE 9

A coated Ti-50A rod prepared as in Example 8 is then treated as follows: a solution (750 cc) containing 72.8 wt. % acetic acid, 7.6 wt. % formic acid, 16.2 wt. % water, 2.0 wt. % hydrobromic acid and 1.4 wt. % ethylene glycol diacetate is charged to a one liter glass flask which is provided with a reflux condenser, a nitrogen sparger, a working electrode comprising the rhodium-coated titanium Ti-50A rod, 2 carbon auxiliary electrodes and a saturated Calomel reference electrode, which is provided with a Luggin probe containing a solution whose composition is the same as the liquid to be tested and which is placed to within 2 mm of the working electrode. The liquid is heated to a temperature of 105° C. under a nitrogen atmosphere and, using a scan rate of 1 millivolt per second, the liquid is subjected to a potentiodynamic polarization analysis to generate a potentiodynamic anodic polarization curve. The anodic polarization curve thereby produced characterizes the tested rod as active (i.e., the test solution corrodes the rod) or passive (i.e., the test solution is substantially noncorrosive to the rod). These curves also permit observation of the rest potential, i.e., "$E_{corr}$". N. D. Greene, *Corrosion*, vol. 18, pp. 136t–142t (1962).

Employing this method of analysis, the Ti alloy is determined to be passive in the test solution, and a rest potential of +177 millivolts is observed.

EXAMPLE 10 FOR COMPARISON

The procedure of Example 9 is repeated except that the Ti-50A rod which is not first coated with rhodium. Analysis by the potentiodynamic anodic polarization method shows the uncoated Ti rod to be active in the test solution, and a rest potential of −507 millivolts is observed.

EXAMPLE 11

To illustrate yet another facile method of electrolytic application of rhodium coatings to Ti metal surfaces according to this invention, 8 linear inches of platinum wire (0.081 inch diameter) are embedded lengthwise in the absorbing portion of a rectangular sponge (0.5 inch in thickness), which is in turn backed with a substantially non-conductive plastic sheet together with handle means. The sponge portion of this applicator device is then immersed in the same solution as Example 6, containing 0.81 gram $RhCl_3.3H_2O$ and 30 ml. HCl in water in order to cause about 20 grams of the solution to be absorbed into the sponge. The upper and lower metal surfaces of a 0.25 inch-thick Ti-50A metal coupon (having upper and lower surface dimensions of 1×3 inches) are then twice contacted with the sponge surface of the applicator using a brushing motion while anodically polarizing the sponge by means of the platinum wire and cathodically polarizing the metal surface of the coupon, using a current density of about 10 ma/cm$^2$ for a total contact period of about 5 sec. for each part of the coupon so contacted. The originally shiny metallic appearance of the untreated coupon is then observed to change to a substantially uniformly dull grey metallic appearance, indicating that rhodium metal is deposited thereon. The rhodium coating is determined to have a thickness of from 0.001 to 0.005 mil.

EXAMPLE 12

Following the procedure of Example 2, the rhodium coated coupon prepared as in Example 11 is suspended in the boiling corrosive liquid at a temperature of 110° C. for a period of 90 hours. After this period of time, the rhodium-coated plate is observed to show no evidence of corrosion (i.e., essentially zero mpy corrosion). Analysis of the corrosive liquid at the conclusion of the 90 hour test period, shows no detectable rhodium in the solution, thereby indicating that the rhodium coating applied as in Example 11 is substantially impervious to the corrosive liquid and does not degrade.

EXAMPLE 13

The procedure of Example 8 is repeated except that the Ti-50A rod which is coated with rhodium comprises a severely corroded rod which is first prepared by contacting an uncoated Ti-50A rod with an aqueous solution containing 48 wt. % HBr, at 60° C., in $H_2O$ at 60° C. for 24 hours. The rhodium coating thus applied is found to be a substantially uniform coating and to have a thickness of about 0.01 mil.

Employing the procedure of Example 9, the rhodium-coated, corroded metal rod is suspended in the corrosive liquid at a temperature of 102° C. Analysis of the liquid by means of potentiodynamic polarization shows the coated rod to be passive in the strong acid medium and to exhibit a rest potential of +276. Thus, the process of this invention permits even previously corroded titanium metal surfaces to be protected against further corrosion.

EXAMPLE 14

The procedure of Example 9 is repeated except that the Ti-50A rod which is used is obtained by the applicator coating technique described in Example 11. The coated rod is determined to be passive in the test liquid and to possess a rest potential of −55 millivolts.

EXAMPLE 15

A rhodium-coated coupon prepared as in Example 1 is exposed, following the procedure of Example 2, to a liquid mixture comprising 70 wt. % isobutyric acid, 5 wt. % water, and 25 wt. % benzene sulfonic acid, employing a temperature of 140° C. under a nitrogen atomsphere. After 30 hours of exposure to the liquid medium, the rhodium-coated titanium coupon is observed to show no evidence of corrosion, and the liquid contains no detectable Rh.

EXAMPLE 16 FOR COMPARISON

Following the procedure of Example 15, an uncoated Ti-50A titanium coupon is exposed to the isobutyric acid/water/benzene sulfonic acid liquid. After 27 hours of exposure, the coupon is determined to have corroded at the rate of 181 mpy.

EXAMPLE 17

A rhodium-coated Ti-50A titanium coupon, prepared as in Example 1, is attached lengthwise, by means of two widths of ¼ inch wide Teflon tape, to a second Ti-50A titanium coupon which is of the same size, but which is uncoated. One (40×20 mm) side of the uncoated coupon (i.e., about 45% of the coupon's total surface area) is therefore in contact with one (40×20 mm) side of the rhodium-coated coupon. The coated-uncoated coupon combination is then treated using the procedure of Example 2 in a boiling liquid containing 70.6 weight percent acetic acid, 7.5 weight percent formic acid, 6.3 weight percent HBr, 11.7 weight percent water and 3.9 weight percent acetic acid esters of ethylene glycol. The coupons are suspended in the boiling liquid at a temperature of 110° C. for a period of 93 hours, after which the test solution is replaced with a fresh solution of the above composition and the coupons are so contacted for an additional period of 92 hours.

After the total contacting period of 185 hours, all surfaces of both the rhodium-coated titanium coupon and the uncoated coupon are observed to show no evidence of corrosion. The uncoated coupon retains its original shiny physical appearance even on those surfaces not actually contacting the rhodium-coupon. Both coupons, over the test period, exhibit an essentially zero mpy rate of corrosion, and the liquids are found to contain no detectable rhodium. Therefore, contacting the uncoated titanium coupon with the rhodium surface of the coated coupon protected the uncoated coupon against corrosion.

EXAMPLE 18 FOR COMPARISON

An uncoated Ti-50A metal coupon is suspended in a liquid having the composition of the boiling liquid used in Example 17, employing the procedure of that example. After 89 hours, the Ti-50A coupon is found to have suffered a corrosion rate of 179 mpy. An observation of the coupon shows evidence of hydriding, thereby indicating severe corrosion.

EXAMPLE 19

The procedure of Example 1 is repeated to prepare a rhodium-coated titanium coupon except that the coupon is not fully immersed in the liquid. Rather, only one half of the coupon is immersed in the liquid containing the rhodium salt. After the electrolytic deposition of the rhodium, at a temperature of 60° C. employing a current density of 10 am/cm$^2$ for a period of about one minute, the treated coupon is determined to have deposited thereon a substantially uniform rhodium metal coating over 50% of its total surface area, the coating so deposited being to a thickness of about 0.02 mil.

The coated coupon so prepared is then suspended, completely immersed, in a boiling liquid medium having the composition set forth in Example 17 for a period of 194 hours at a temperature of 111° C. At the end of this time of treatment, the coupon is removed from the liquid, and is determined to exhibit a rate of corrosion of essentially zero mpy. Both the rhodium-coated and uncoated metal surfaces of the coupon are observed to show no evidence of corrosion, and the liquid is found to contain no detectable rhodium.

EXAMPLE 20

The procedure of Example 8 is repeated to prepare a partially rhodium-coated titanium rod except that one end of the rod is placed in the liquid containing the rhodium salt so as to immerse only 5% of the rod's total surface area in the liquid. The electrolytic deposition of the rhodium is conducted at a temperature of 60° C., a current density of 10 am/cm$^2$ for a period of about 1 minute. The treated rod is determined to have deposited thereon a substantially uniform rhodium metal coating over the immersed surface area. The coating which is so deposited is found to have a thickness of about 0.2 mil.

The rod which is so prepared is then subjected to analysis by the potentio dynamic anodic polarization method described in Example 9, except that the test solution in which the rod is immersed comprises 70.6 weight percent acetic acid, 7.5 weight percent formic acid, 6.3 weight percent HBr, 11.7 weight percent water and 3.9 weight percent acetic acid esters of ethylene glycol. Employing a temperature of 105° C. and a scan rate of 1 millivolt per second, the rod is determined to be passive in the presence of the test liquid and to exhibit a rest potential of +77 millivolts.

EXAMPLE 21

Following the procedure of Example 1 in separate runs, one end of a thin rod of Ti-50A titanium metal having a length of 45.1 cm and a diameter of 0.32 cm is electrolytically coated with rhodium to provide a substantially uniform rhodium metal coating of about 0.01 mil in thickness over the desired portion of the rods' surface area. Each rod is then subjected to potentiodynamic analysis employing the procedure of Example 9 except that an 18 gauge platinum wire, 45 cm. long, is used as the auxiliary electrode and except that the test solution in which the rod is immersed comprises 1200 cc of a liquid containing 15.9 weight percent water, 6.6 weight percent formic acid, 70.6 weight percent acetic acid, 3.0 weight percent HBr and 3.9 weight percent ethylene glycol diacetate. An uncoated Ti-50A titanium rod is employed as a control. The data thereby obtained are set forth in Table IV below.

Table VI

| Run No. | % Rod Surface area having Rh coating | Corrosion Effect Potentiodynamic Analysis | $E_{corr}$ (millivolts) |
|---|---|---|---|
| Control | 0 | Active | −444 |
| 1 | 0.18 | Active | −413 |
| 2 | 1.4 | Passive | −212 |
| 3 | 2.7 | Passive | +9 |

EXAMPLE 22

In a series of experiments, rhodium-coated Ti-50A, 316 stainless steel and 304 stainless steel rods, each having the same dimensions (1 cm. diam.; 5 cm$^2$ area) are prepared according to the procedure of Example 8, and are then exposed to a liquid containing 60 weight percent acetic acid, 6 weight percent formic acid, 16 weight percent water, 3 weight percent HBr and 15 weight percent ethylene glycol diacetate. The liquids containing the tested rods in each run are analyzed by the potentio dynamic polarization method according to the procedure of Example 9. Uncoated rods of each metal are employed as controls. The data thereby obtained are set forth in Table VII below.

Table VII

| Run No. | Rod | Corrosion Effect Potentiodynamic Analysis | $E_{corr}$ (mv) | $I_c$* (ma/cm$^2$) |
|---|---|---|---|---|
| 1 | Rh-coated 316SS | Active | −200 | 2600 |
| 2 | Uncoated 316SS | Active | −242 | 5000 |
| 3 | Rh-coated 304SS | Active | −218 | 5000 |
| 4 | Uncoated 304SS | Active | −294 | 5000 |
| 5 | Rh-coated Ti-50A | Passive | +120 | <10 |
| 6 | Uncoated Ti-50A | Active | −450 | 3600 |

*"$I_c$" = corrosion current
Note: "SS" = stainless steel.

The rhodium coating in Runs 1 and 3 is observed to come off the substrate stainless steel during the period of time in which the coated stainless steel rods are contacted with the corrosive liquid. In addition, both the rhodium-coated and uncoated stainless steel rods in Runs 1 through 4 are visually observed to disintegrate rapidly in the corrosive liquid, so rapidly that corrosion rates in units of mpy could only be estimated to be well in excess of 200 mpy.

Therefore, it can be seen that the long-lived rhodium coating of titanium articles is not readily adapted to protection of stainless steels. This is entirely consistent with the teachings of the prior art which required an undercoating over stainless steels of a substantially nonporous metal prior to coating of the stainless steel articles with rhodium.

EXAMPLE 23

Following the procedure of Example 9, rhodium coated Ti-50A rods are exposed to a variety of strong acid media, having the compositions set forth in Table VIII below, and are tested by the potentiodynamic polarization method. Uncoated coupons are employed as controls. The data thereby obtained are set forth in Table VIII below.

Table VIII

| Run No. | Coupon | Strong Acid Media Composition | (wt. %) | Corrosion Effect Potentio-dynamic Analysis | (mv.) |
|---|---|---|---|---|---|
| 1 | Rh-coated | Methanol | 15 | Passive | +130 |
| | | $H_2O$ | 15 | | |
| | | HI | 10 | | |
| | | Acetic Acid | 60 | | |
| 2 | Uncoated | Methanol | 15 | Active | −475 |
| | | $H_2O$ | 15 | | |
| | | HI | 10 | | |
| | | Acetic Acid | 60 | | |
| 3 | Rh-coated | Acetic Acid | 75 | Passive | +300 |
| | | HCl | 10 | | |
| | | $H_2O$ | 5 | | |
| | | Formic Acid | 5 | | |
| | | Vinyl acetate monomer | 5 | | |
| 4 | Uncoated | Acetic Acid | 75 | Active | −420 |
| | | HCl | 10 | | |
| | | $H_2O$ | 5 | | |
| | | Formic Acid | 5 | | |
| | | Vinyl acetate monomer | 5 | | |
| 5 | Rh-coated | Acetic Acid | 50 | Passive | +150 |
| | | Formic Acid | 40 | | |
| | | Water | 10 | | |
| 6 | Uncoated | Acetic Acid | 50 | Active | −530 |
| | | Formic Acid | 40 | | |
| | | Water | 10 | | |

Therefore, the process of this invention for protection of titanium articles is applicable to a wide variety of strong acid media.

From the foregoing, it will be apparent that our invention provides novel substantially non-corrosive titanium materials of construction which are suitable for use in constructing chemical process apparatus which are intended for use in contact with strong acid media in the substantial absence of externally applied, anodically polarizing voltage to the materials in use in contact with the strong acid media. This novel material construction is uniquely resistant to corrosion attack by oxidizing acid media. Preferably, the materials of construction will, as has been described above, be provided with a metallic rhodium coating having a thickness of at least about 0.001 mil. over at least 1%, and more preferably at least 2%, of the surface area of the titanium or titanium alloy metal surfaces which are intended for use in contact with the oxidizing acid medium and which are therefore desired to be protected against corrosion. The coatings can be applied by any conventional technique, such as by use of electrolysis or fastening devices, as have been described above. Following the application of the coating of metallic rhodium, the coated titanium or titanium alloy articles so prepared are exposed to temperatures of less than about 400° C., preferably less than about 300° C. It has been surprisingly found, as has been pointed out above, that it is not necessary, and is indeed economically undesirable, to heat treat the non-corrosive materials prepared in this invention to temperatures required by the prior art, for example, to form a rhodium-titanium alloy on the surface of the materials.

The process of this invention and the Ti articles formed thereby can be therefore particularly useful in the protection of titanium equipment used in the processing of aqueous media containing lower alkanoic acids (e.g., $CH_3CO_2H$, $HCO_2H$ and the like), halogenated, especially brominated, iodinated, and/or chlorinated, organic compounds (e.g., brominated derivatives of vicinal glycol esters) or free hydrohalic acids (e.g., HCl, HI or HCl) or mixtures thereof, alone or in combination with such organic compounds as (1) vicinal glycol esters (e.g., mono- and di-alkanoic acid esters of ethylene glycol or propylene glycol), methanol or vinyl acetate monomer, such as are produced in U.S. Pat. Nos. 3,262,969; 3,668,239; 3,689,535; 3,715,388; 3,715,389; 3,743,762; 3,770,813; 3,778,468; 3,872,164; 3,907,874 and 4,073,876 and in Canadian Patent 888,749 (as to vicinal glycol esters), in U.S. Pat. No. 3,769,329 (as to alcohols and their derivatives), and in British Pat. No. 1,063,434 (as to vinyl acetate monomer).

The Rh-coated articles prepared by the process of this invention find particular utility in the substantial absence of molecular oxygen (whether dissolved or in the gaseous state), i.e., less than about 1 vol. % oxygen.

It will be obvious that various changes and modifications can be made without departing from the invention, and it is intended, therefore, that all matter contained in the foregoing description shall be interpreted as illustrative only and not as limitative of the invention.

We claim:

1. Substantially non-corrosive titanium materials of construction for chemical process apparatus intended for use in contact with strong acid media in the substantial absence of externally applied, anodically polarizing voltage to the said materials of construction, said material of construction comprising titanium or a titanium alloy containing titanium in an amount of at least 50 weight percent of the alloy, said titanium or titanium alloy having a discontinuous coating of metallic rhodium of a thickness of from about 0.0001 to 1 mil over at least 1% of the surface of said materials which is intended for use in contact with said strong acid media, said materials of construction, following the application of said metallic rhodium coating, being exposed to a temperature of less than about 400° C.

2. Construction materials according to claim 1 in which the metallic rhodium coating is provided over at least 2% of said surfaces intended for use in contact with said strong acid media.

3. Construction materials according to claim 1 wherein said strong acid media comprise aqueous media containing at least one member selected from the group consisting of lower alkanoic acids, halogenated organic compounds and free hydrohalic acids.

4. Construction materials according to claim 1 wherein the surfaces of said material which are intended for use in contact with said strong acid media are further intended for use in the substantial absence of molecular oxygen.

* * * * *